US005971863A

United States Patent [19]

Durso

[11] Patent Number: 5,971,863

[45] Date of Patent: Oct. 26, 1999

[54] PUTTING TOUCH TRAINER

[75] Inventor: Joseph M. Durso, Reston, Va.

[73] Assignee: Perfect Lie Golf Ltd., L.C., Reston, Va.

[21] Appl. No.: 09/059,709

[22] Filed: Apr. 14, 1998

Related U.S. Application Data

[62] Division of application No. 08/613,627, Mar. 11, 1996, Pat. No. 5,779,567.

[51] Int. Cl.[6] ..... A63B 69/36

[52] U.S. Cl. ..... 473/159; 473/162; 473/180; 473/196; 473/171; 473/176

[58] Field of Search ..... 473/174, 180–189, 473/159, 162, 196, 171, 409, 179, 173, 195, 176

[56] References Cited

U.S. PATENT DOCUMENTS

| | | | |
|---|---|---|---|
| 815,649 | 3/1906 | Smith | 473/180 |
| 1,513,917 | 11/1924 | Long | 473/178 A |
| 3,019,023 | 1/1962 | Westling | 473/180 |
| 3,081,090 | 3/1963 | Congleton | 473/185 |
| 3,135,538 | 6/1964 | George | 285/363 |
| 3,700,243 | 10/1972 | Kenney | 473/180 |
| 4,275,886 | 6/1981 | Bannon | 473/180 |
| 4,359,225 | 11/1982 | Baldorossi et al. | 473/178 A |
| 4,691,922 | 9/1987 | Peel et al. | 473/188 |
| 4,906,006 | 3/1990 | Sigunick | 473/179 |
| 4,936,583 | 6/1990 | Peabody et al. | 473/185 |
| 5,013,042 | 5/1991 | Garnes | 473/180 |
| 5,257,808 | 11/1993 | Mueller et al. | 473/174 |
| 5,275,404 | 1/1994 | Dimaano et al. | 473/180 |
| 5,435,560 | 7/1995 | Kehoe | 473/174 |
| 5,478,071 | 12/1995 | Barrs et al. | 473/176 |

OTHER PUBLICATIONS

Practical Golf Products, CarpetCup Information From Internet, Downloaded Nov. 27, 1996.

Snead, Sam, *Golf Begins at Forty*, "Stroke Long Putts Close, Short Putts In," pp. 152–153.

Spalding, Wedge Putting Cup, Stock No. 24019.

*Primary Examiner*—George J. Marlo
*Attorney, Agent, or Firm*—Christopher John Rudy

[57] ABSTRACT

A golf training device including flat, web material having a transverse dimension of about ½ to 3 feet, and a single internal target hole having a diameter of about 4 ¼ inches. The softness, flexibility and thinness of the web material is such that, with the web material placed on a holeless surface, a golf ball rolling thereto by a putting stroke, will be only slightly impeded by both the peripheral boundary of the web material, and the circumferential boundary of the target hole.

20 Claims, 1 Drawing Sheet

PUTTING TOUCH TRAINER

This is a divisional of application Ser. No. 08/613,627 filed on Mar. 11, 1996. The specification of that parent application is incorporated herein by reference. Said application Ser. No. 08/613,627 issued on Jul. 14, 1998 as U.S. Pat. No. 5,779,567.

FIELD

This invention concerns a golf swing training item, particularly useful for increasing the accuracy of a golf stroke such as a putt or chip, and method of use therewith.

BACKGROUND

The game of golf is certainly a challenge to play, but a frustration to many. Oftentimes, the average player becomes most frustrated in his poor performance around the hole.

In an 18-hole round of golf, par for the course usually is allotted to include some thirty-six putts on the greens. How many occasional, weekend, or even frequent golfers fail to obtain the standard two putts per green, but instead blow up to a 3-putt, 4-putt, or unspeakably-higher-putt hole, is, most mercifully, actually unknown. However, that number is widely acknowledged to be exceedingly high, and the prime cause of many a high final score.

The standard theory is, with the first putting stroke, from the far away lie, to putt up to a position close around the hole, and on the next stroke tap the ball into the cup. Many golfers, though, feel compelled to go straight for the hole, often bypassing or falling short of it by a great distance, if even lined up with the hole. Rolling terrain or imperfections on the green complicate matters, of course.

The chip shot may be considered in appropriate circumstances to be a long putt, with the first portion of the shot causing the ball to be in flight rather than to roll along the ground. The object of the chip shot is to position the ball fairly close to the cup so that a short putt may be taken. However, like the putt, many golfers aim for the pin or hole, and have little touch with this type of shot, when it is touch that is needed. Consequently, their short game falters, and their score mounts.

In addressing the problem, golf instructors usually stress practice, and this is indispensable. However, with ineffective practice comes ineffective play on the course.

One method of practice involves putting on a putting practice green which has grass or sand to match that on the actual course. The putting practice green has a number of holes, generally of the same size as those on the actual course, set therein, at which the golfer aims and into which the ball may drop. However valuable this practice may be, and it can be of high value, especially immediately before beginning an actual game, it in itself usually facilitates any development of touch slowly over a long time through much repeated practice. It is the trial and error method, unmodified, and unless the theories are kept well in mind while putting, which can be very difficult, the student of the game finds that he has developed little putting skill.

Another method involves the use of devices such as rug, brush or artificial turf mats, with a hole cut out for the cup, into which the ball drops. These may be of some value, as with the putting practice green, but suffer from similar drawbacks, if not worse, depending on design, and so forth.

Other methods involve using portable, artificial cups.

For example, a well-known artificial putting cup, in general, has a flat, disc-like base with tiltable, levered leaves about its perimeter. Each leaf rests with its outer edge down and its inner part up. A golf ball can roll over the leaves to enter the disc center but cannot exit from the center of the disc to the outside. However, drawbacks of this device include an unnatural appearance; the necessity of ball speed to achieve enough momentum to ram the ball into the cup; and the inability to develop touch, which is to say that achieving a correct putting distance remains a problem, particularly when the ball is shot so hard.

As another example, a commercially available wedge putting cup has a truncated oval shape and forms a ramp onto which a ball rolls up when putted. A hole in the ramp is present, and it is into the hole which has a back wall about ½-inch in height that the ball is to be contained. A flag may be inserted behind the hole for a marker. This device, too, has its drawbacks, which include its wedge shape which requires the ball to have enough speed to achieve enough momentum to roll up the ramp to the hole, and the high walled hole design. Thus, this device has an inability to develop touch.

Although some of the foregoing devices may help develop aim, again, none effectively develops touch, especially over a relatively short period. What accordingly is lacking and needed in the art are ways and means to develop touch with putting, chipping, and so forth shots, especially putting.

SUMMARY

The present invention provides a golf swing touch trainer comprising a portably-sized, substantially flat web material having a peripheral boundary within which an internal target is present such that the web material peripheral boundary surrounds and is external to the internal target, onto a top surface of which material a ball can roll from a surface on which the trainer can be placed, and over or on which material the ball can roll and rest. Further provided is a method of golf instruction which comprises providing a putting touch trainer, placing the trainer on a suitable surface, providing a ball, placing the ball on the trainer or a suitable surface from which it can be struck toward the trainer, providing a club, and swinging or directing swinging of the club so as to strike the ball and move it toward a position on or closer to the trainer.

The invention is useful in golf swing training.

Significantly, by the invention, the student of the game of golf can effectively, rather quickly, not only develop his aim, but also, most importantly, develop his golf swing touch, especially with strokes such as putting and chipping. Psychologically, the student sees a large aiming mark, not just a small cup or hole, and aims for the large aiming mark first. With such a large aiming mark, the web material, the student of the game is put at ease and learns that it is more important to first be able to hit the large aiming mark than to immediately aim to hit or roll over the more difficult small target, the internal target of the web material, to be successful. Thus, he learns to place his shot on the intended aiming mark with high frequency. Other putts to the internal target can be practiced to develop great close-in touch especially for the cup. The invention is simple to manufacture and use, and it is praiseworthy.

Numerous further advantages attend the invention.

DRAWINGS

The drawings form part of the specification hereof. In the drawings, which are not necessarily drawn to scale and in which like numerals refer to like features, the following is briefly noted:

ILLUSTRATIVE DETAIL

The invention can be further understood by reference to the present detail, taken in conjunction with the drawings. The same is to be construed in an illustrative but not necessarily limiting sense.

Touch relates directly to distance, which is the most difficult aspect of putting. It requires constant practice. The trainer of this invention allows this practice to be accomplished indoors, and its target size de-emphasizes direction and strongly emphasizes distance. Every expert agrees that, after line-up, the idea is to think only of distance. This becomes more of a matter of mental practice than physical.

With reference to FIGS. 1–5, golf swing touch trainer 100 is depicted. It is a generally portable item, i.e., is portably-sized, although it may be fastened to a surface more permanently such as by spiking, gluing, or otherwise affixing it permanently or removably, e.g., by making it to have its bottom surface include a hook portion of a hook and loop substance such as VELCRO (Reg. U.S. Pat. & Tm. Off.) fastener material, which may attach to a complimentary loop portion which may include the pile of certain carpets. Preferably, the trainer 100 is fully portable and if attachable, removably attachable.

Figure 1:
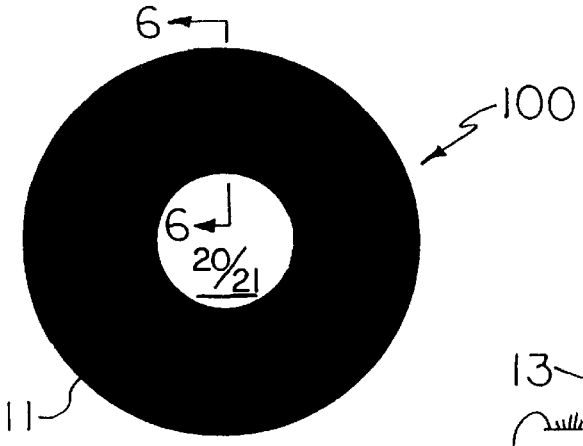
FIG. 1 is a top plan view of a game touch trainer of the invention especially adaptable for the game of golf.
Figure 2:
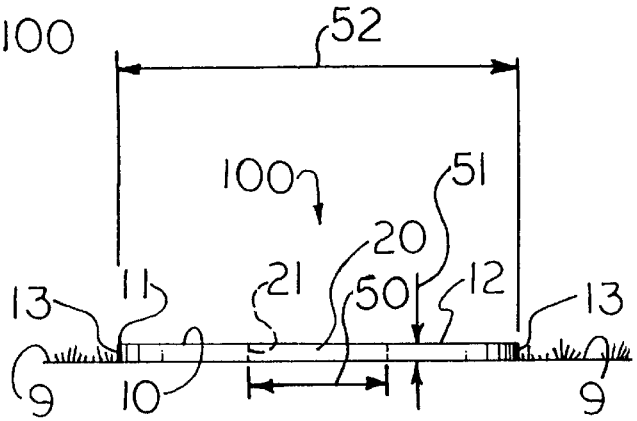
FIG. 2 is a side view of the trainer of FIG. 1.
Figure 3:
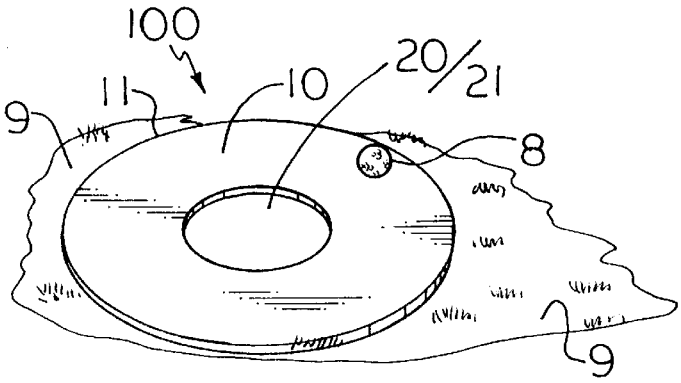
FIG. 3 is a perspective view of the trainer of FIGS. 1 & 2, in use.
Figure 5:
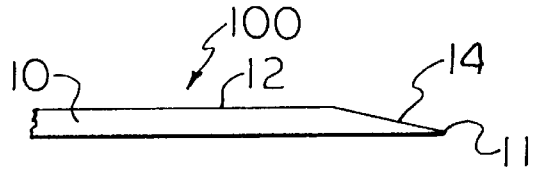
FIG. 5 is a side view of another embodiment of a game touch trainer of the invention.

The golf swing trainer 100 is preferably adapted as a putting touch trainer, and it includes substantially flat web material 10 and peripheral boundary 11. Onto or into the web material 10 is internal target 20, which may be a printed-on or woven-in internal aiming area such as an outline of a circle or bull's eye or an area of a completely different color than that of the surrounding web material 10, a hole 21, as shown in FIGS. 1–3, and so forth. The web material 10 surrounds the internal target 20, or at least the peripheral boundary 11 of the web material 10 surrounds the internal target 20. Preferably, the internal target 20 is a hole 21, especially one which is circular and has a diameter 50 approximate or equal to the diameter of a standard golf course putting green hole. For example, the target 20 or hole 21 may be a circle with a 4 ¼ - inch diameter 50 (FIG. 2). The web material 10 has upper or top surface 12 such that golf ball 8 can roll from a surface 9 on which the putting touch trainer 100 can be placed onto the top surface 12 of web material 10. Accordingly, side 13, which in FIG. 2 is seen as normal to upper top surface 12 of the web material 10, is not high enough to obstruct, or better, significantly impair, the rolling movement of the ball 8 onto the top surface 12 of web material 10. As seen in FIG. 5, side 14 is beveled or tapered to accommodate this phenomenon, especially should the web material 10 be of a thickness which itself might impede the golf ball 8 from rolling onto the top surface 12 of the web material 10. The web material 10, at least in a substantial part of its upper or top surface 12, is also such that the golf ball 8 can roll over and rest on the same as appropriate to the momentum which a rolling golf ball has, stopped by the friction which the golf ball 8 in contact with the top surface 12 of the web material 10 has.

Thickness of the golf swing touch trainer may vary. However, it is advantageous to provide the trainer with a substantially thin thickness, or side profile 51, such that a golf ball 8 can roll onto the top surface 12 of the trainer 100 without being substantially impeded in its travel. To attain such a goal a trainer 100, for example, as depicted in FIGS. 1–3, may have at most an about 1/32-inch to about 3/32- or 1/8-inch, or an about 1/16-inch, side profile 51 (FIG. 2) dimension, or less. Such thin dimensions can play a large part in the successful training of touch when the internal target 20 is a hole 21 with its boundary. A rolling golf ball will only be slightly impeded by such thin dimensions, and it will remain in the internal aiming target or hole when it is stroked with the right touch to keep it there, for large part, on its own. Since the hole 21 in a thin web material 10 does aid to a slight degree the maintaining of a ball therein, without allowing the student of the game to "ram the ball home," which develops no touch, a golfer is encouraged also by a number of balls which are retained in such a shallow depression or hole 21, which develops touch.

Figure 4:
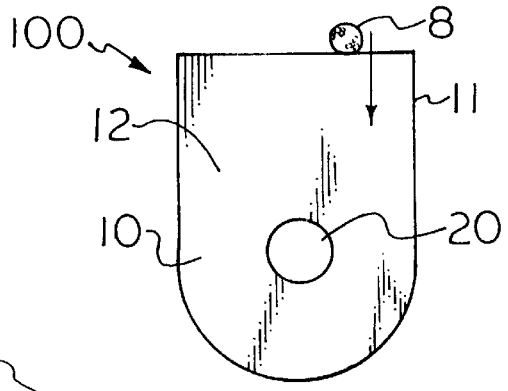
FIG. 4 is a top plan view of another embodiment of a game touch trainer of the invention.

Shapes of the golf swing touch trainer 100, more aptly defined by the shape of the web material 10 as defined by its peripheral boundary 11, include those which are circular as shown in FIGS. 1 & 3, and truncated elliptical or oval as shown in FIG. 4. Alternate shapes for the golf swing training item, as viewed from the top, can include ellipses, ovals, other curvilinear shapes including generalized figure-eights and truncated versions thereof, and so forth, polygonal shapes such as triangles, quadrilaterals including trapezia, trapezoids, rhombi, rectangles and squares, pentagons, hexagons, heptagons, octagons, nonagons, decagons, and so forth. The circle is preferred.

Actual sizes of the trainer may vary. For employment as a putting touch trainer, for instance, the trainer 100 may be about from half a foot or eight inches to one and one half or two or three feet in general cross section, for example, being about one foot in diameter, as defined by its boundary 11. When the trainer 100 may be employed as a chipping touch trainer, for instance, it may be made to have sizes the same as those of the putting touch trainer, but may be in larger sizes such as up to about three feet or more in general cross section.

The internal target 20 may be disposed at any suitable location within the boundary 11. However, it generally occupies a more central location, as those of skill in the art can appreciate. In the case of a circular boundary 11, it is advantageous for more effective play following upon practice to place the target 20 in the center of the web material, to form a concentric arrangement.

Figure 6:
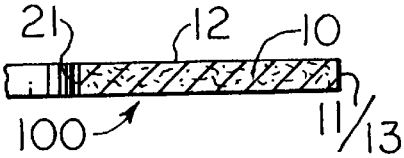
FIG. 6 is a cross sectional view of the trainer of FIGS. 1–3, taken along section indicator 6—6 depicted in FIG. 1.

Materials which may be employed may vary widely, and in general, are those suitable for providing the article of or used in the invention. For example, a putting or chipping touch trainer may be made of an artificial leather material. Other suitable materials may include paper; woven grass or other crude plant fibers; cloth to include cotton, cotton canvas, nylon, rayon, and other natural and/or synthetic cloth(s); natural or synthetic rubber; cast, extruded or molded plastics, including acetates, polyolefins to include polyethylene, polypropylene, vinyls, blends therewith, and so forth and the like; cast glass and/or glass fiber containing materials, including woven glass mats alone or employed as a reinforcement in a plastic matrix; coated or uncoated metals; and so forth and the like. Preferably, the material is relatively soft and flexible. For example, a vinyl plastic material may be relatively soft and flexible and preferred thus, as well as can be imitation or real (actual) leathers. Note FIG. 6. Thus, the trainer to include trainer 100 may be folded or rolled up for storage and brought out and positioned on the suitable surface to lay down on and conform therewith, especially about its boundary 11.

Colors of the trainer may vary. As an illustration, the trainer may be green, blue, red, black and/or white. Green is a good color, for that is the color of grass, but a dark color or shade, for example, black, may have the advantage of simulating a hole or easily discernible area, which can be impressionable and memorable as to the aiming area to be employed in real play after the trainer is no longer needed. Note FIG. 1.

Use of the golf swing touch trainer of the invention and golf swing touch training instruction can be provided by a method of the invention. The method includes providing a web material golf swing touch trainer. The web material golf swing touch trainer, in essence, is a golf swing touch trainer, as set forth above, however, not necessarily having the internal target of the golf swing touch trainer. Preferably, nonetheless, the web material golf swing touch trainer is a golf swing touch trainer, as set forth above, with the internal target. The trainer is placed on a suitable surface such as an actual grass or sand putting green, artificial turf, a carpet or rug, and so forth. Especially with the use of the golf swing touch trainer of the invention, more especially one in which the internal target is a hole with a diameter about the size of the diameter of the diameter of a hole or cup on an actual or practice putting green, the student of the game may set the trainer about the hole of the putting green, advantageously positioning the internal target of the golf swing touch trainer in general registry with the hole of the putting green. Thus, with pin in or pin out, a more attainable aiming mark is provided for chipping and/or putting practice. A golf ball is provided, and placed on a suitable surface from which it can be struck toward the trainer. The suitable surface from which the ball can be struck is not necessarily the same general surface as that upon which the trainer itself is placed. For example, the trainer may be placed on one part of an indoor carpet, and the ball placed on another carpet, say, some 10–15 feet away; alternatively, it may be placed on a putting green with the ball on the green or fringe of the green, a fairway, rough, the sand of a sand trap, or even on a practice mat or practice pad, especially those invented by Mr. Joseph M. Durso, U.S. Pat. Nos. 5,035,433 and 5,110,133; International Patent Application Publication No. WO 92/01496; U.S. patent application Ser. Nos. 08/541,734 and 08/541,490; and U.S. provisional patent application Ser. No. 60/010,562. In the alternative, and preferably, the ball may be placed on the same general surface as the trainer, for example, on the same putting green, carpet, artificial mat, and so forth. In preferred practice of the invention the device is used in putting indoors where the invention is particularly suited for developing general touch on indoor carpets; the touch developed is easily transferred to the actual course by a few practice putts on the practice green. A golf club is provided, for example, a putter, an approaching iron or other iron or club for chipping, and so forth and the student of the game swings the club and/or an instructor directs the student of the game to swing the club to strike the ball and move it toward the trainer.

Accordingly, a success pattern can be developed. First, especially when putting, psychologically from outside of ten feet it becomes easy to hit the web material surrounding the internal target or hole rather than the internal target or hole. The standard putting cup target becomes "expanded." Thus, a primary goal can be achieved. Achieving this primary goal in itself is of high value and can lower a golfer's score significantly. Second, having mastered the first element of the success pattern, the golfer can strive to cause the golf ball in the internal target or hole in a substantially thin web material. Thus, the student of the game can develop a most refined golf swing touch, which with minimal pre-game tuning is transferable to actual greens, and an uncanny accuracy is developed, especially in putting.

CONCLUSION

The present invention is thus provided. Numerous modifications can be effected within its spirit, the literal claim scope of which is particularly pointed out as follows.

I claim:

1. A golf swing touch trainer comprising:

a portably-sized, substantially flat, relatively soft and flexible web material having a top horizontal surface whereon essentially all of which a golf ball can roll and rest, a bottom surface generally in vertical registry with and essentially parallel to the top surface, and a peripheral boundary having a transverse dimension about from one-half foot to three feet;

a single internal target hole within the peripheral boundary such that the peripheral boundary surrounds and is external to the internal target hole, wherein the internal target hole is substantially circular and has a diameter of approximately 4 ¼ inches, to correspond to the standard diameter of a full sized outdoor golf course putting green hole; and a substantially thin side profile, with the degree of softness, flexibility and thinness of said web material being such that the golf ball can roll across any part of the peripheral boundary from a holeless surface upon which the trainer can be placed and onto the top surface without being substantially impeded in its travel and only be slightly impeded by such thin side profile and such that the golf ball also only be so slightly impeded by the generally circumferential boundary of the target hole.

2. The trainer of claim 1, wherein the peripheral boundary is at least in part curvilinear.

3. The trainer of claim 2, wherein no hole other than the internal target hole is present in the web material.

4. The trainer of claim 3, wherein the side profile is at most about one eighth of an inch.

5. The trainer of claim 2, wherein the side profile is at most about one eighth of an inch.

6. The trainer of claim 2, wherein the side profile is about from one thirty-secondth to three thirty-secondths of an inch; the peripheral boundary is circular, and the internal target hole is placed centrally within the peripheral boundary.

7. The trainer of claim 6, wherein no hole other than the internal target hole is present.

8. The trainer of claim 7, wherein the web material is an imitation of actual leather.

9. The trainer of claim 7, wherein the top surface generally has a dark color or shade, and the peripheral boundary is about from eight to eighteen inches in diameter.

10. The trainer of claim 9, wherein the web material is an imitation leather, and the top surface includes black, and the peripheral and circumferential boundaries are not beveled.

11. The trainer of claim 6, wherein the web material is an imitation of actual leather.

12. The trainer of claim 6, wherein the peripheral boundary is about from eight to eighteen inches in diameter.

13. The trainer of claim 12, wherein the top surface generally has a dark color or shade.

14. The trainer of claim 2, wherein the peripheral boundary is circular, and the internal target hole is placed centrally within the peripheral boundary.

15. The trainer of claim 14, wherein the top surface generally has a dark color or shade, and the peripheral boundary is about from eight to eighteen inches in diameter.

16. The trainer of claim 1, wherein no hole other than the internal target hole is present in the web material.

17. The trainer of claim 16, wherein the side profile is at most about one eighth of an inch.

18. The trainer of claim 1, wherein the side profile is at most about one eighth of an inch.

19. In combination, the trainer of claim 1 and a support surface devoid of any ball receiving opening underneath the target hole upon which the trainer can be placed.

20. The combination of claim 19, wherein the side profile is less than about one eighth of an inch; the peripheral boundary is circular, and the target hole is placed centrally within the peripheral boundary.

* * * * *